US008044892B2

(12) United States Patent
Chaussy et al.

(10) Patent No.: US 8,044,892 B2
(45) Date of Patent: Oct. 25, 2011

(54) AUTOMATIC ADAPTATION OF THE PRECHARGE VOLTAGE OF AN ELECTROLUMINESCENT DISPLAY

(75) Inventors: Danika Chaussy, Brie Ei Angonne (FR); Céline Mas, Poisat (FR)

(73) Assignee: STMicroelectronics S.A., Montrouge (FR)

( * ) Notice: Subject to any disclaimer, the term of this patent is extended or adjusted under 35 U.S.C. 154(b) by 1290 days.

(21) Appl. No.: 11/294,991

(22) Filed: Dec. 6, 2005

(65) Prior Publication Data

US 2006/0118700 A1 Jun. 8, 2006

(30) Foreign Application Priority Data

Dec. 6, 2004 (FR) ..... 04 52867

(51) Int. Cl.
*G09G 3/30* (2006.01)

(52) U.S. Cl. ..... 345/76; 345/82; 345/204; 315/169.3

(58) Field of Classification Search ..... 345/76–83, 345/55, 30, 46, 84, 204, 212; 315/169.3; 702/107; 250/214.1
See application file for complete search history.

(56) References Cited

U.S. PATENT DOCUMENTS 6,594,606 B2 * 7/2003 Everitt ..... 702/107
6,750,840 B2 * 6/2004 Morita ..... 345/100
2002/0097002 A1 7/2002 Lai et al.
2003/0184237 A1 10/2003 Togashi et al.
2004/0017725 A1 * 1/2004 Mas et al. ..... 365/222
2006/0001613 A1 * 1/2006 Routley et al. ..... 345/76

OTHER PUBLICATIONS

French Search Report from French Patent Application No. 04/52867, filed Dec. 6, 2004.

* cited by examiner

*Primary Examiner* — Lun-Yi Lao
*Assistant Examiner* — Kelly B Hegarty
(74) *Attorney, Agent, or Firm* — Lisa K. Jorgenson; William R. McClellan; Wolf, Greenfield & Sacks, P.C.

(57) ABSTRACT

A circuit for controlling a matrix display formed of light-emitting diodes, capable of successively selecting lines of the screen and, for each line from a set of selected lines, of selecting columns, the voltage of each selected column settling at an operating voltage. The circuit is capable, before selection of each line from said set of lines, of precharging at least the columns to be selected to a precharge voltage. The circuit includes a device for adjusting the precharge voltage including a measurement circuit capable, on each selection of a line from said set of lines, of measuring the maximum operating voltage from among the operating voltages of the selected columns; a circuit capable of storing the maximum measured operating voltage; and a circuit capable of adjusting the precharge voltage based on the maximum stored operating voltage.

8 Claims, 3 Drawing Sheets

AUTOMATIC ADAPTATION OF THE PRECHARGE VOLTAGE OF AN ELECTROLUMINESCENT DISPLAY

BACKGROUND OF THE INVENTION

1. Field of the Invention

The present invention relates to electroluminescent display matrix screens formed of a set of light-emitting diodes. These are for example screens formed of organic diodes ("OLED", for Organic Light Emitting Display) or polymer diodes ("PLED" for Polymer Light Emitting Display). The present invention more specifically relates to the regulation of the precharge voltage of the control circuits of the light-emitting diodes of such screens.

2. Discussion of the Related Art

FIG. 1 shows an example of a matrix screen 10 with light-emitting diodes. Each pixel of screen 10 is formed of a light-emitting diode 12. Diodes 12 are arranged in Y lines and X columns. The cathodes of diodes 12 of a same line are connected to a line electrode 14, and the anodes of diodes 12 of a same column are connected to a column electrode 16.

The display of an image on screen 10, according to currently-used standards, is obtained by the display of a frame or of two successive frames. On display of a frame, the addressing of matrix screen 10 is performed line after line via a circuit for controlling lines 18 (commonly called a line driver). The electrode of line 14 of the selected or active line is connected to ground while the line electrodes of the inactive lines are left at high impedance or are connected to a high voltage. Simultaneously, the information corresponding to the activation or to the non-activation of diodes 12 of the active line will be transmitted by column electrodes 16 via a circuit for controlling columns 20 (commonly called a column driver) which injects a current into column electrodes 16 connected to diodes 12 to be activated.

FIG. 2 shows a more specific modeling of a pixel of matrix screen 10 of FIG. 1. Each pixel is formed of a non-resistive and non-capacitive light-emitting diode 12 in parallel with a stray capacitor 22. For a 300-$\mu m^2$ pixel formed of an organic or polymer light-emitting diode, such a stray capacitor may have a capacitance on the order of 25 picofarads. A first resistor 24 in series with diode 12 represents the resistance of the portion of column electrode 16 connected to the pixel. A second resistor 25 in series with diode 12 represents the resistance of the portion of line electrode 14 connected to the pixel.

Due to the very capacitive character of the pixels, part of the current in the activation of a pixel will first be necessary to charge stray capacitor 22 to the voltage at which diode 12 must operate. A portion only of the current is thus used for the light emission. The luminance of diode 12 will be proportional to the average time during which diode 12 carries a current and to the average value of this current. As an example, the power consumption of an activated pixel of a matrix display with organic light-emitting diodes can be broken out into a power consumption for the light emission of diode 12 of the pixel, which amounts to approximately 57% of the total power consumption, a parasitic power consumption, of approximately 40%, linked to the capacitive character of the pixel, and a resistive power consumption, of approximately 3%, linked to series resistors 24, 25 of the pixel.

The time required to charge the stray capacitance 22 associated with the pixel defines the turn-on duration of the pixel and reduces the duration of the active phase corresponding to the light emission of the pixel. The turn-on duration especially depends on the intensity of the current provided to the pixel to be activated. The global duration of a pixel addressing phase being constant, the longer the turn-on duration, the lower the achieved luminance will be for a same current flowing through diode 12.

To solve such a disadvantage, a precharge of all the pixels of a matrix display 10 can be performed before selection of a screen line. The addressing with precharge enables biasing each pixel of screen 10 to a voltage close to that that it would have if it was active so that the current injected into a diode 12 to be activated is only used for the light emission and not for charging stray capacitance 22 of the pixel.

FIGS. 3A to 3C describe successive steps of an addressing with precharge of the pixels.

In FIGS. 3A to 3C, a single column electrode 16 of screen 10 of FIG. 1 has been shown and a single pixel 26, connected to column electrode 16, which is desired to be activated, has been isolated. Pixel 26 is represented by a diode 12 and an associated stray capacitance 22 (parasitic resistors 24, 25 are not shown). Line electrode 14 connected to pixel 26 has been shown and the other line electrodes of screen 10 have been symbolized by a single branch 14' connected to the anode of diode 12. A capacitor 22' is shown on branch 14' and is equivalent to the assembly of the stray capacitors in parallel of the pixels connected to column electrode 16 and to the other line electrodes of screen 10. The capacitance of capacitor 22' is substantially equal to (Y−1) times the capacitance of a stray capacitor 22.

Only the specific elements of the column control circuit 20 associated with the considered column electrode 16 have been shown, knowing that such elements are identical for each column electrode of screen 10.

Line control circuit 18 comprises two switches 27, 28 enabling connecting line electrode 14 alternately to ground GND or to a high voltage $V_{OFF}$. Only line electrode 14 being activated, for the other screen lines, the line control circuit has been symbolized by two switches 27', 28' enabling connection of branch 14' alternately to ground GND or to high voltage $V_{OFF}$.

Column control circuit 20 comprises three switches 31, 32, 33 enabling connection of column electrode 16 alternately to ground GND, to a precharge voltage $V_{PRE}$, or to a first terminal of a current source $I_{LUM}$. The second terminal of current source $I_{LUM}$ is connected to a bias voltage source $V_{POL}$.

FIG. 3A shows a first step of an addressing with precharge consisting, between the successive selection of two lines of screen 10, of discharging all the pixels of screen 10. All the screen lines are then inactive, which means that all line electrodes 14, 14' of screen 10 are connected to high voltage $V_{OFF}$. Each column electrode 16 is then connected to ground GND, via switch 31, to discharge stray capacitors 22, 22' of all the pixels connected to column electrode 16.

FIG. 3B shows a second step consisting, before selection of a line, of charging all the pixels of screen 10. All line electrodes 14, 14' remain connected to high voltage $V_{OFF}$. Each column electrode 16 is brought to a precharge voltage $V_{PRE}$ via switch 32. Stray capacitor 22 of each pixel is then precharged to voltage $V_{PRE}$-$V_{OFF}$. Precharge voltage $V_{PRE}$ is close to the voltage at which column electrode 16 may operate on activation of pixels at the next step.

FIG. 3C show a third step, or active phase, corresponding to the activation of pixel 26. Line electrode 14 connected to pixel 26 to be activated is connected to ground GND via switch 27. Line electrodes 14' of the inactive lines remain connected to high voltage $V_{OFF}$. Current source $I_{LUM}$ is connected to pixel 26 via switch 33. A current can thus flow through diode 12 which emits light. Current source $I_{LUM}$ only has to charge capacitor 22 having a capacitance which is (Y−1) times as small as the capacitance of capacitor 22', which very slightly affects the turn-on time of diode 12. The voltage on the anode of diode 12 settles at an operating voltage $V_{COL}$.

The first discharge step aims at discharging the stray capacitors 22 of all the screen pixels to erase the residual charges of the pixels which might result from the activation of pixels of screen 10 at previous steps.

The second precharge step enables reducing the turn-on duration of the pixel to obtain an active phase duration which is substantially independent from the intensity of the lighting, that is, from the intensity of the current flowing through the diodes in active phase.

It is also possible to only perform a precharge of the screen columns to be activated, as described in U.S. Pat. No. 5,594,468.

The light-emitting diodes of a screen are not identical and, for a same luminance current, the voltage across activated diodes may be different. However, since such differences are generally relatively small, the same precharge voltage is applied to each selected column to simplify the column control circuit.

Conventionally, the precharge voltage is predefined, for example, empirically, and remains constant during the screen operation. However, a predefined precharge voltage is generally not optimal. Indeed, the operating voltage of a selected column may significantly vary according to luminance current $I_{LUM}$ that can change for each selected line. Further, for a same luminance current flowing through a light-emitting diode, the voltage across the diode tends to increase along with the diode aging. For a same luminance, corresponding to a given luminance current, the operating voltage of the column thus varies along time.

Upon selection of a column, the voltage applied onto the selected column switches from the precharge voltage to the operating voltage. The precharge voltage can thus not be too distant from the operating voltage of the column to avoid modifying the luminosity of the activated light-emitting diode. Indeed, if the precharge voltage is too high, too high a current must temporarily be conducted by the activated light-emitting diode, the active line then appearing with a light intensity greater than the desired light intensity. Conversely, if the precharge voltage is too small, the voltage of each selected column must rise from the precharge voltage up to the operating voltage. The current flowing through the active light-emitting diode may be temporarily smaller than the desired value, the active line then appearing with a light intensity smaller than the desired light intensity.

SUMMARY OF THE INVENTION

An object of the present invention is to provide a circuit for controlling a matrix display comprising a device that provides a precharge voltage which depends on the operating voltages of the columns.

Another object of the present invention is to provide a circuit for controlling a matrix display comprising a device for providing a precharge voltage of simple design.

To achieve these and other objects, the present invention provides a circuit for controlling a matrix display formed of light-emitting diodes distributed in lines and columns, capable of successively selecting lines of the screen and, for each line of a set of selected lines, of selecting columns to turn on the light-emitting diodes of said line and of said selected columns, the voltage of each selected column settling at an operating voltage, said circuit being further capable, before selection of each line from said set of lines, of precharging at least said columns to be selected to a precharge voltage. The control circuit comprises a device for adjusting the precharge voltage comprising a measurement circuit capable, on each selection of a line from said set of lines, of measuring the maximum operating voltage among the operating voltages of said selected columns; a storage circuit capable, on each selection of a line from said set of lines, of storing the maximum measured operating voltage; and an adjustment circuit capable, after each selection of a line from said set of lines, of adjusting the precharge voltage based the maximum stored operating voltage.

According to an embodiment of the present invention, the measurement circuit is capable, on each selection of a line from said set of lines, of measuring the maximum voltage from among the voltages of the columns of the matrix display, the measurement circuit comprising a protection circuit capable of deactivating the measurement circuit for each column associated with a non-conductive light-emitting diode.

According to an embodiment of the present invention, the storage circuit is capable of keeping the measurement of the maximum operating voltage for at least the duration of the display of an image on the matrix display in the absence of a new maximum operating voltage measurement.

According to an embodiment of the present invention, the control circuit comprises a current mirror comprising a reference branch and several duplication branches connected to a bias voltage, each duplication branch being connected to a column, the reference branch being connected to a source of a reference current.

According to an embodiment of the present invention, each branch of the current mirror comprises a field-effect PMOS-type duplication transistor having its source connected to the bias voltage, the gates of the transistors of each branch being connected together, the drain and the gate of the transistor of the reference branch being connected to the reference current source, the drains of the transistors of the duplication branches being connected to the columns.

According to an embodiment of the present invention, the measurement circuit comprises, for each column, a field-effect PMOS-type protection transistor having its source connected to the bias voltage and having its drain connected to the drain of the duplication transistor and a field-effect NMOS-type measurement transistor having its drain connected to the protection transistor and having its gate connected to the column, the sources of the measurement transistors being connected to a measurement point.

According to an embodiment of the present invention, the storage circuit comprises a capacitor having a terminal connected to the measurement point via a switch.

The present invention also provides a method for adjusting a precharge voltage of a control circuit of a matrix display formed of light-emitting diodes distributed in lines and in columns, comprising the step of successively selecting lines of the matrix display and of repeating, for each line from a set of selected lines, the steps of precharging columns to the precharge voltage; selecting said line; selecting columns to turn on the light-emitting diodes of said line and of said selected columns, the voltage of each selected column settling at an operating voltage; measuring the maximum operating voltage among the operating voltages of said selected columns; storing said maximum operating voltage; and adjusting the precharge voltage from the maximum stored operating voltage.

According to an embodiment of the present invention, the step of measurement of the maximum operating voltage comprises the steps of providing a circuit capable, on each selection of a line from said set of lines, measuring the maximum voltage from among the column voltages of the matrix display and of deactivating the measurement circuit for each column associated with a non-conductive light-emitting diode.

According to an embodiment of the present invention, said maximum operating voltage is stored for at least the duration of the display of an image on the matrix display in the absence of a new measurement of the maximum operating voltage.

The foregoing and other objects, features, and advantages of the present invention will be discussed in detail in the following non-limiting description of specific embodiments in connection with the accompanying drawings.

DETAILED DESCRIPTION

Figure 1:
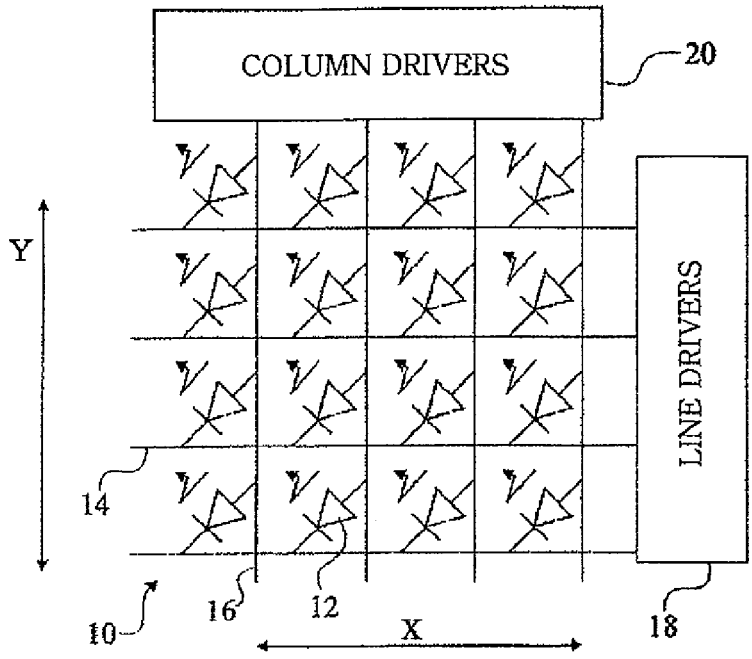
Fig 1 (Prior Art)
FIG. 1, previously described, shows a matrix display with light-emitting diodes.
Figure 2:
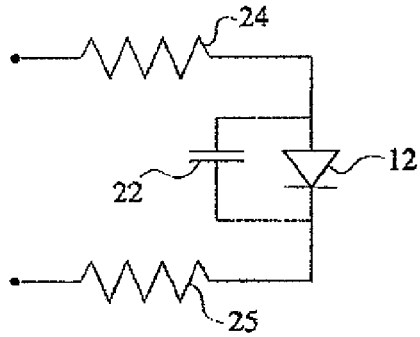
Fig 2 (Prior Art)
FIG. 2, previously described, shows a modeling of a pixel of a light-emitting diode matrix display.
Figure 3A:
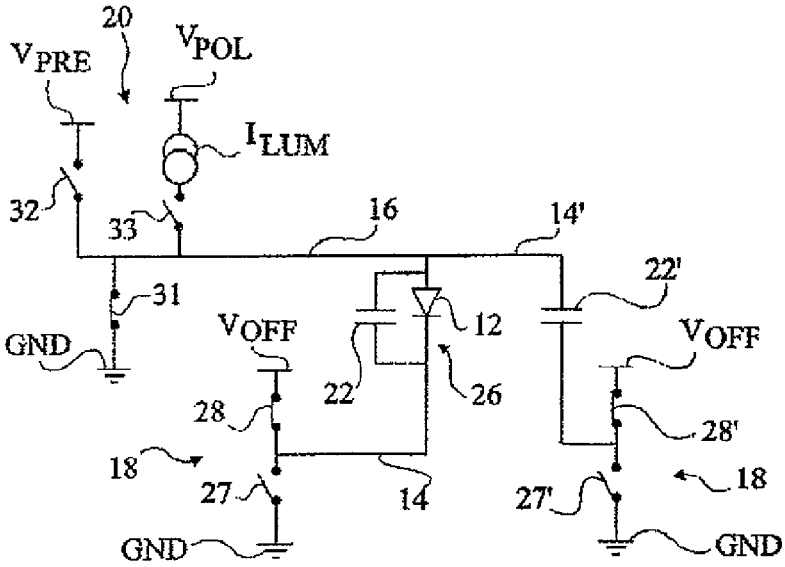
Fig 3A (Prior Art)
FIGS. 3A to 3C, previously described, illustrate successive steps of a conventional method for displaying an image on the screen of FIG. 1.
Figure 3B:
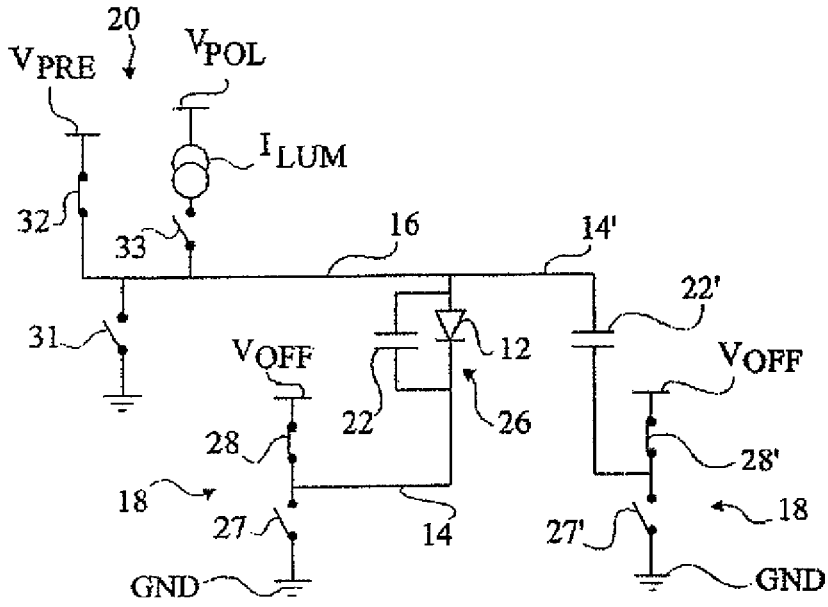
Fig 3B (Prior Art)
Figure 3C:
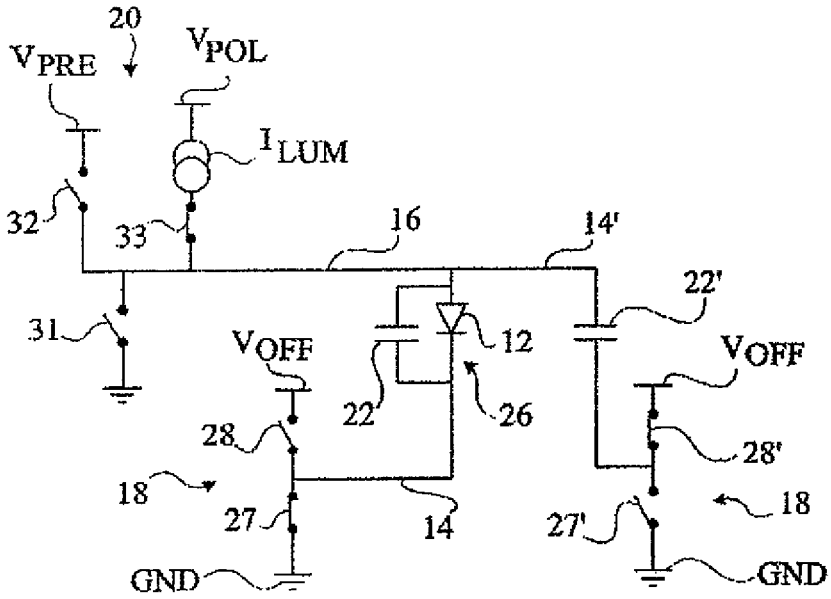
Fig 3C (Prior Art)
Figure 4:
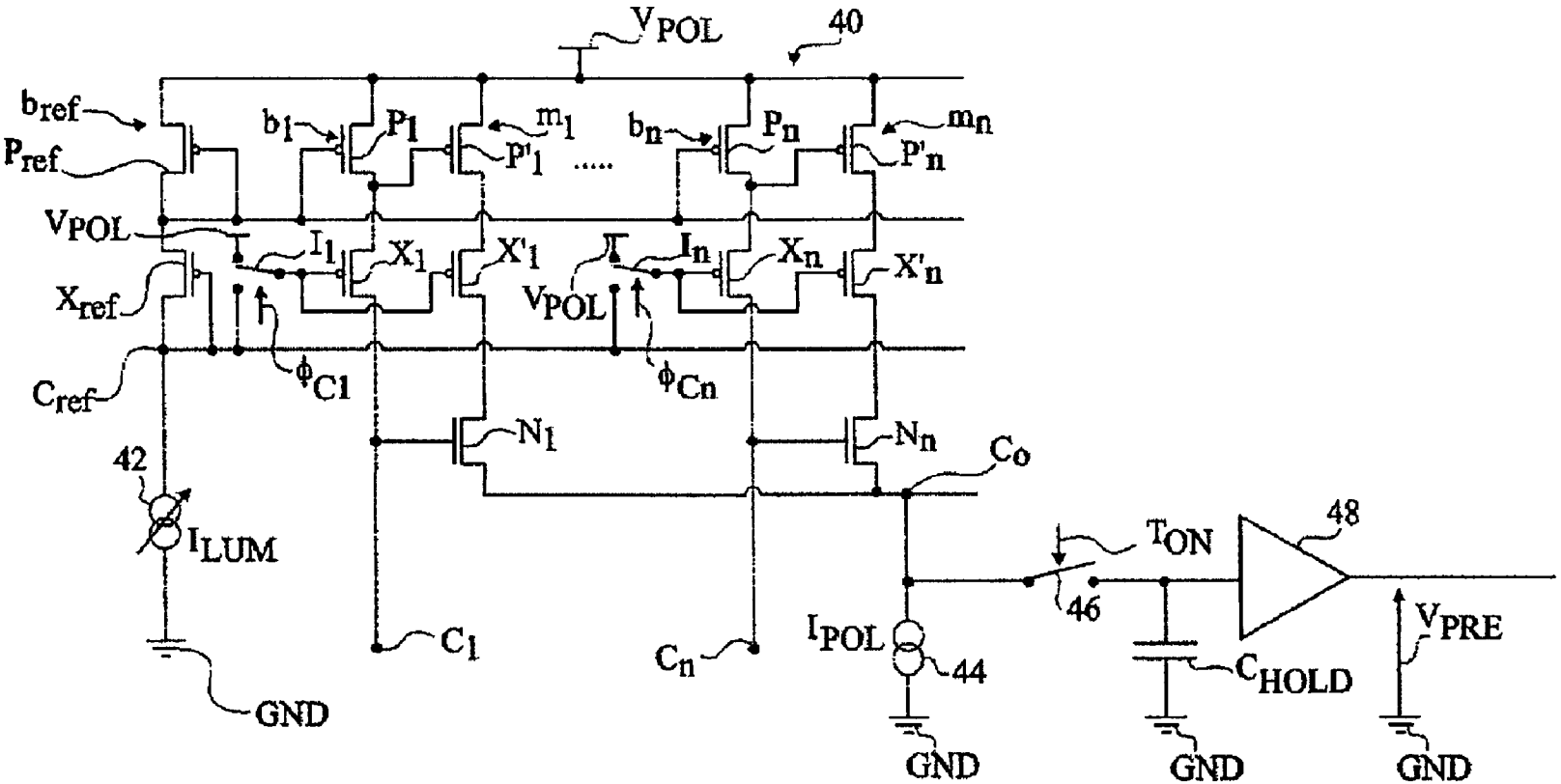
FIG. 4 illustrates an example of the forming of a device for providing the precharge voltage according to the present invention.

FIG. 4 shows an example of the forming of column control circuits and of the precharge voltage provision device according to the present invention.

The column control circuits comprise a current mirror 40 formed in the present example of a reference branch $b_{ref}$ and of n duplication branches $b_1$ to $b_n$. Each branch is formed of a PMOS transistor, $P_{ref}$ for the reference branch and $P_1$ to $P_n$ for branches $b_1$ to $b_n$. The sources of the transistors of each of the branches are connected to bias voltage $V_{POL}$ and the gates are interconnected. The drain and the gate of transistor $P_{ref}$ of reference branch $b_{ref}$ are connected to a source of a PMOS power transistor $X_{ref}$. The drain of transistor $X_{ref}$ is connected to a terminal of a reference current source 42 at a point $C_{ref}$. The other terminal of current source 42 is connected to a low reference voltage, for example, ground GND. The gate of power transistor $X_{ref}$ is connected to point $C_{ref}$. Reference current source 42 provides a luminance current $I_{LUM}$. The drain of each transistor $P_i$, i ranging between 1 and n, is connected to the source of a PMOS power transistor $X_i$ having its drain connected to a point $C_i$ of a column electrode (not shown). Each power transistor, $X_{ref}$ and $X_1$ to $X_n$, enables limiting the voltage between the source and the drain of the transistor, $P_{ref}$ and $P_1$ to $P_n$, corresponding to the operating range of this transistor. The gate of each power transistor $X_i$, i ranging between 1 and n, is connected to a terminal of a switch $I_i$ with two positions, controlled by a signal $\phi_{Ci}$, capable of connecting the gate of transistor $X_i$ to reference point $C_{ref}$ when signal $\phi_{Ci}$ is for example at a high level or to bias voltage $V_{POL}$ when signal $\phi_{Ci}$ is at a low level. When signal $\phi_{Ci}$ is high, transistor $X_i$ is on and the voltage between point $C_i$ and the ground settles at the operating voltage of the column. The control circuits further comprise, for each column, a switch (not shown) capable of connecting point $C_i$ to ground GND and a switch (not shown) capable of connecting point $C_i$ to the precharge voltage.

The present invention comprises providing, for each duplication branch $b_i$, i ranging between 1 and n, a measurement circuit $m_i$ comprising a PMOS transistor $P'_i$, having its source connected to bias voltage $V_{POL}$ and having its gate connected to the drain of transistor $P_i$ of the corresponding duplication branch $b_i$. The drain of each transistor $P'_i$ is connected to the source of a PMOS power transistor $X'_i$ having its gate connected to the gate of power transistor $X_i$ of the corresponding duplication branch $b_i$. Power transistor $X'_i$ enables limiting the voltage between the source and the drain of the associated transistor $P'_i$ within the operating range of this transistor. The drain of each power transistor $X'_i$ is connected to the drain of a follower-assembled NMOS transistor $N_i$ having its gate connected to point $C_i$. The sources of transistors $N_1$ to $N_n$ are connected, at a point $C_o$, to a terminal of a current source 44 having its other terminal connected to ground GND. Current source 44 provides a bias current $I_{POL}$ for the biasing of NMOS transistors $N_1$ to $N_n$. A switch 46, controlled by a signal $T_{ON}$, enables connecting point $C_o$ to a terminal of a capacitor $C_{HOLD}$ having its other terminal connected to ground GND. The voltage across capacitor $C_{HOLD}$ drives an amplifier 48 which provides precharge voltage $V_{PRE}$.

The operation of such a circuit is the following. Before a phase of activation of a screen line, all the columns, or only the columns to be selected at the next activation phase, are charged to precharge voltage $V_{PRE}$. In the activation phase, signals $\phi_{C1}$ to $\phi_{Cn}$ are at the high state for the selected columns and at the low states for the other columns. The voltage between point $C_i$ of a selected column and the ground settles at the operating voltage of the column. Transistors $N_1$ to $N_n$ being follower-assembled, the voltage between point $C_o$ and ground GND is equal to the highest voltage among the voltages between points $C_1$ to $C_n$ and ground GND. Switch 46 is then turned on and the voltage between node $C_o$ and ground GND is applied across capacitor $C_{HOLD}$. Switch 46 is turned on only when at least one pixel of a line is lit. The on duration of switch 46 may vary but does not exceed the duration of a screen line activation phase to avoid discharge of capacitor $C_{HOLD}$ with current $I_{POL}$. Based on the voltage maintained across capacitor $C_{HOLD}$, amplifier 48 provides a new precharge voltage $V_{PRE}$ which is used at the next column precharge step.

For a non-selected column, transistor $X_i$ is off and the corresponding point $C_i$ is grounded. Transistor $N_i$ is then off. The voltage between point $C_i$ and ground GND is thus not taken into account for the determination of precharge voltage $V_{PRE}$.

The present invention thus enables adjusting precharge voltage $V_{PRE}$ according to the time variations of the operating voltages of the screen diodes.

The device according to the present invention further enables providing a precharge voltage $V_{PRE}$ independently from the presence of defects of "open" pixel or "short-circuited" pixel type. An "open" pixel corresponds to a cutting in the connection between the column and the anode of the light-emitting diode of the pixel or to a cutting in the connection between the line and the cathode of the light-emitting diode. A "short-circuited" pixel corresponds to a short-circuit between the line and the column at the pixel level.

In the case of an "open" pixel, for example, the pixel of the column associated with point $C_1$, when power transistor $X_1$ is on, the column being open and at high impedance, the voltage at the drain of transistor $P_1$ rises up to bias voltage $V_{POL}$. The voltage on the gate of transistor $P'_1$ is then equal to bias voltage $V_{POL}$ and transistor $P'_1$ is off. No current then flows through transistor $P'_1$. Transistor $N_1$ is then no longer supplied and cannot charge capacitor $C_{HOLD}$. The voltage between point $C_1$ and ground GND is thus not taken into account for the determination of precharge voltage $V_{PRE}$. If the drain of transistor $N_1$ was directly connected to bias voltage $V_{POL}$, the voltage at the source of transistor $N_1$ would then be equal to the difference between voltage $V_{POL}$ and the gate-source voltage of transistor $N_1$ and the voltage obtained at point $C_o$ would be incorrect. Transistor $P'_1$ thus enables not taking into account the operating voltage of an "open" pixel column.

In the case of a short-circuited pixel, for example, the pixel of the column associated with point $C_1$, point $C_1$ is directly grounded. Transistor $N_1$ is thus off. The voltage between point $C_1$ and ground GND is thus not taken into account for the determination of precharge voltage $V_{PRE}$.

The capacitance of capacitor $C_{HOLD}$ is sufficiently high to limit leakages is at the level of capacitor $C_{HOLD}$ at least for the duration corresponding to the activation of all the screen lines. This enables providing a correct precharge voltage $V_{PRE}$ even in the case where a single screen line is lit on display of an image on screen.

Of course, the present invention is likely to have various alterations, modifications, and improvements which will readily occur to those skilled in the art. In particular, the current mirrors may be formed with a greater number of transistors.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A circuit for controlling a matrix display formed of light-emitting diodes distributed in lines and columns, capable of successively selecting lines of the matrix display and, for each line of a set of selected lines, of selecting columns to turn on the light-emitting diodes of said line and of said selected columns, the voltage of each selected column settling at an operating voltage, said circuit being further capable, before selection of each line from said set of lines, of precharging at least said columns to be selected to a precharge voltage, and comprising a device for adjusting the precharge voltage comprising:

a measurement circuit configured, on each selection of a line from said set of lines, to measure a maximum operating voltage among the operating voltages of said selected columns, the measurement circuit being configured to measure the maximum operating voltage independently of the presence of an open or short-circuited light-emitting diode in the selected line;

a storage circuit configured, on each selection of a line from said set of lines, to store only a single measured value of the maximum operating voltage;

an adjustment circuit configured, after each selection of a line from said set of lines, to adjust the precharge voltage of all the selected columns of the line based on the single stored value of the maximum operating voltage; and a current mirror comprising a reference branch and several duplication branches connected to a bias voltage, each duplication branch being connected to a column, the reference branch being connected to a source of a reference current, wherein each branch of the current mirror comprises a field-effect PMOS-type duplication transistor having its source connected to the bias voltage, the gates of the transistors of each branch being connected together, the drain and the gate of the transistor of the reference branch being connected to the reference current source, the drains of the transistors of the duplication branches being connected to the columns, and wherein the measurement circuit comprises, for each column, a field-effect PMOS-type protection transistor having its source connected to the bias voltage and having its gate connected to the drain of the duplication transistor and a field-effect NMOS-type measurement transistor having its drain connected to the protection transistor and having its gate connected to the column, the sources of the measurement transistors being connected to a measurement point.

2. The control circuit of claim 1, wherein the measurement circuit is deactivated for each column associated with a non-conductive light-emitting diode.

3. The control circuit of claim 1, wherein the storage circuit is configured to store the measurement of the maximum operating voltage for at least the duration of the display of an image on the matrix display in the absence of a new maximum operating voltage measurement.

4. The control circuit of claim 1, wherein the storage circuit comprises a capacitor having a terminal connected to the measurement point via a switch.

5. A circuit for precharging columns of a matrix display to a precharge voltage, the matrix display including light-emitting diodes arranged in lines and columns, line drivers to select a line of the matrix display, and column drivers to select columns to turn on the light-emitting diodes of the selected line, each selected column having an operating voltage, the circuit comprising:

a measurement circuit configured to measure, on each selection of a line, a maximum operating voltage among the operating voltages of the selected columns, the measurement circuit being configured to measure the maximum operating voltage independently of the presence of an open or short-circuited light-emitting diode in the selected line;

a storage circuit configured to store, on each selection of a line, only a single measured value of the maximum measured operating voltage;

an adjustment circuit configured to adjust, after each selection of a line, the precharge voltage of all the selected columns based on the single stored value of the maximum-operating voltage; and a current mirror including a reference branch and a plurality of duplication branches connected to a bias voltage, each duplication branch being connected to a column of the matrix display, the reference branch being connected to a source of a reference current, wherein each branch of the current mirror comprises a P-type duplication transistor having its source connected to the bias voltage, the gates of the duplication transistors being connected together, the drain and the gate of the transistor of the reference branch being connected to the reference current source and the drains of the duplication transistors being connected to respective columns of the matrix display, and wherein the measurement circuit comprises, for each column, a P-type protection transistor having its source connected to the bias voltage and having its gate connected to the drain of the duplication transistor, and an N-type measurement transistor having its drain connected to the protection transistor and having its gate connected to the column, the sources of the measurement transistors being connected to a measurement point.

6. The circuit of claim 5, wherein the measurement circuit is deactivated for each column associated with a non-conductive light-emitting diode.

7. The circuit of claim 5, wherein the storage circuit is configured to hold the maximum stored operating voltage for at least the duration of the display of an image on the matrix display.

8. The circuit of claim 5, wherein the storage circuit comprises a capacitor having a terminal connected through a switch to the measurement point.

* * * * *

UNITED STATES PATENT AND TRADEMARK OFFICE

CERTIFICATE OF CORRECTION

PATENT NO. : 8,044,892 B2
APPLICATION NO. : 11/294991
DATED : October 25, 2011
INVENTOR(S) : Danika Chaussy et al.

It is certified that error appears in the above-identified patent and that said Letters Patent is hereby corrected as shown below:

Title Page,
Item (75) should read:
(75) Inventors: Chaussy; Danika (Brie et Angonne, FR), Mas; Celine (Poisat, FR)

Signed and Sealed this
Twenty-ninth Day of November, 2011

David J. Kappos
*Director of the United States Patent and Trademark Office*